US010371155B2

(12) United States Patent
Hägele et al.

(10) Patent No.: US 10,371,155 B2
(45) Date of Patent: Aug. 6, 2019

(54) FAN ASSEMBLY HAVING A ROTATINGLY DRIVE HUB

(71) Applicant: Hägele GmbH, Schorndorf (DE)

(72) Inventors: Karl Hägele, Schorndorf (DE); Markus Lechler, Schorndorf (DE); Walter Lechler, Urbach (DE)

(73) Assignee: HÄGELE GMBH, Schorndorf (DE)

( * ) Notice: Subject to any disclaimer, the term of this patent is extended or adjusted under 35 U.S.C. 154(b) by 866 days.

(21) Appl. No.: 14/894,217

(22) PCT Filed: May 19, 2014

(86) PCT No.: PCT/EP2014/001340
§ 371 (c)(1),
(2) Date: Jun. 15, 2016

(87) PCT Pub. No.: WO2014/191087
PCT Pub. Date: Dec. 4, 2014

(65) Prior Publication Data

US 2016/0290341 A1 Oct. 6, 2016

(30) Foreign Application Priority Data

May 27, 2013 (DE) ..... 10 2013 008 902

(51) Int. Cl.
*F04D 19/00* (2006.01)
*F04D 29/32* (2006.01)
*F04D 29/36* (2006.01)

(52) U.S. Cl.
CPC ..... *F04D 19/005* (2013.01); *F04D 29/329* (2013.01); *F04D 29/362* (2013.01); *F05B 2270/328* (2013.01)

(58) Field of Classification Search
CPC .... F04D 19/005; F04D 29/329; F04D 29/369; F04D 29/323; F04D 29/362; F04D 29/364; F01P 7/06; F01P 5/043; F05B 2270/328; B64C 11/30; F01D 7/00; F01D 1/30
USPC ..... 416/5
See application file for complete search history.

(56) References Cited

U.S. PATENT DOCUMENTS

| | | | | |
|---|---|---|---|---|
| 1,650,776 | A | 11/1927 | Stock | |
| 6,439,850 | B1 | 8/2002 | McCallum et al. | |
| 2002/0192078 | A1* | 12/2002 | McCallum | F04D 29/063 416/25 |
| 2005/0100444 | A1 | 5/2005 | McCallum et al. | |

FOREIGN PATENT DOCUMENTS

| | | |
|---|---|---|
| DE | 20 2009 008 726 | 11/2009 |
| EP | 0 361 982 | 4/1990 |

OTHER PUBLICATIONS

International Search Report dated Aug. 4, 2014 in PCT International Application No. PCT/EP2014/001340.

* cited by examiner

*Primary Examiner* — Dwayne J White
*Assistant Examiner* — Justin A Pruitt
(74) *Attorney, Agent, or Firm* — Faegre Baker Daniels LLP

(57) ABSTRACT

The invention relates to a fan assembly having a rotatingly driven hub (7) and fan blades (10) which can be pivoted relative to the hub body (29). The fan blades (10) are adjusted by means of a linear drive in the form of a spindle drive (13) or a piston drive (52).

19 Claims, 7 Drawing Sheets

FAN ASSEMBLY HAVING A ROTATINGLY DRIVE HUB

CROSS-REFERENCE TO RELATED APPLICATION

Figure 1:
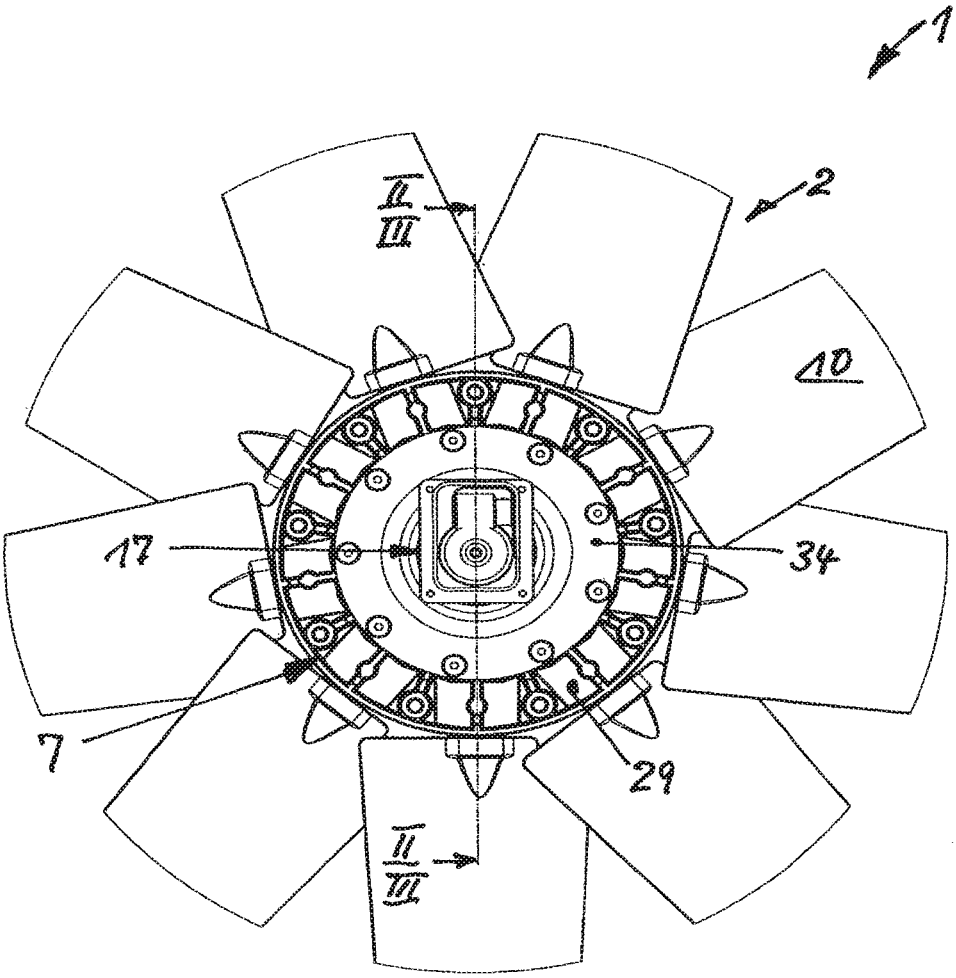

The present application is a National Stage of International Application No. PCT/EP2014/001340, filed May 19, 2014, which claims priority to DE 10 2013 008 902.6, filed May 27, 2013, the entire disclosures of which are hereby expressly incorporated herein by reference.

The invention relates to a fan assembly having a rotatingly driven hub in accordance with the preamble of Claim 1.

A fan assembly known from U.S. Pat. No. 1,650,776 A has fan blades that are radially supported in relation to the hub of the fan wheel and mounted in the hub housing, such that they can be adjusted about their pivot axes to axially opposing directions of flow. The drive for the hub is obtained via a belt drive having a belt pulley, which is formed by an axial extension of the hub housing. In the region of this extension, the hub is axially mounted in a stationary manner on a section of a supporting neck permanently connected to an internal combustion engine. Starting from an internal combustion engine-side drive, an actuating drive designed as a linear drive passes through the supporting neck, by means of which actuating drive the fan blades can be adjusted in terms of their pitch in order to adjust the direction of flow and the flow rate. This actuating drive has a spindle drive inserted in the supporting neck, by means of which an actuator in the form of a drive rod inserted into the supporting neck can be displaced axially. An annular body, which is non-rotatable in relation to the hub housing, that can be adjusted axially, is supported on the drive rod, which annular body lies such that it radially overlaps the fan blades that can be adjusted in terms of their pitch, and is connected thereto via supporting elements that are engaged eccentrically to their pivot axes.

The invention addresses the object of designing a fan assembly of the type specified above with respect to the most compact construction thereof, which preferably also enables the implementation of different designs of the fan assembly while retaining the basic structure thereof.

This is achieved with the features of Claim 1, to which the further Claims provide useful, and in part independently useful, designs.

An axially very compact construction is obtained through the design according to Claim 1, having a central actuator, lying in the axial overlapping region in relation to the annular body and the fan blades, and also supported in this region in relation to the supporting neck. This is accompanied by favorable loading conditions, and also makes it possible to obtain a lighter dimensioning of the components, irrespective of the prevailing, in part also abrupt, loads. In particular, despite the drive connection between the actuator and the control element, functioning as parts of a linear drive, in the region of the radial supporting plane of the annular body in relation to the actuator, this drive connection is at least substantially free of supporting forces, because the actuator, for its part, is guided as a whole onto the supporting neck and supported thereon such that it can be axially displaced. A radially very compact construction also benefits from a design of this type, because, since it is freed of supporting forces, the control element can have a reduced diameter in the region in which it engages with the actuator for the transference of actuating forces, with a corresponding reduced design of the sleeve-shaped supporting neck for receiving the bearing connection to the supporting body preferably formed by a ball bearing race.

The design according to the invention for the fan assembly also offers, in particular, favorable possibilities for a different design of the linear drive provided for the adjustment of the fan blades, which is received in the fan hub. One such possibility is the design as a spindle drive having a spindle that has been inserted in the supporting neck such that it is supported in an axially stationary manner, and an actuator that can be adjusted axially via the spindle, wherein a design of this type can be very readily obtained, in particular with an electric motor drive for the linear drive. The actuator is designed in a design of this type, in particular, in the form of a sleeve-shaped supporting body, which axially overlaps the supporting neck at its free end of the supporting neck, which is connected by means of a threaded connection to the spindle in the region of its end that extends beyond the supporting neck, in particular by means of a recessed collar.

Constructively, simple possibilities are provided with such a solution, e.g., in order to implement an axial support of an annular collar of the spindle by means said annular collar in relation to the supporting neck, as well as an axial stop surface in the displacement path of the actuator in relation to the supporting neck.

A further possibility for the design of the linear drive is to design it as a piston drive, wherein with this design as well, a very simply basic structure, which substantially corresponds to that of a spindle drive, is provided. With a piston drive of this type, a piston is received, for practical purposes, as an actuator element in a cylinder chamber of the supporting neck, such that it can be displaced axially. The piston functioning as an actuator element is connected, for practical purposes, to the actuator via a piston rod received in the supporting neck, at least such that it is axially stationary, wherein here as well, the actuator can be formed by a sleeve body that can be displaced axially in relation to the supporting neck, and which is supported in a non-rotating manner.

A fan assembly constructed in this manner can also be accommodated in predetermined tight installation spaces between an internal combustion engine and cooler, due to its axially very compact construction, wherein the drive connection between the internal combustion engine and the fan wheel is preferably allocated at the side of the fan wheel lying opposite the supporting neck, against which the thread of the spindle comes to an end, starting at which the supporting neck extends in the opposite direction to a gear housing.

With a linear drive in the form of a spindle drive, for example, a drive connection for a separate drive motor can end thereon, which drive motor is disposed at a spacing to the gear housing and, if applicable, is supported independently thereof, as well as having a drive connection to the spindle via a shaft drive having a rigid or flexible shaft. With an assembly of this type, the shaft preferably extends substantially parallel to the plane of the fan wheel, such that the axial length thereof is not significantly increased.

It is also within the scope of the invention to mount the drive motor to the gear housing by means of a flange. For this, the drive motor can be installed in a space saving manner, at least in part also in the radial overlapping region for supporting the supporting neck in an extended cover region of the hub of the fan wheel, such that a compact overall assembly is likewise obtained.

A further possibility with respect to the arrangement of a separate drive motor for the spindle drive consists of designing the gear housing as a combined motor/gear housing, in which the drive motor is disposed such that is encompasses, in an annular manner, the hub of the fan wheel for a central support of the supporting neck in the extended cover region.

In particular in conjunction with such designs for the drive connection of the drive motor to the spindle, but also in general with respect to a static, favorable support of the fan wheel, it has been shown to be practical to axially support both sides thereof in a stationary manner, with an actuating drive for adjusting the pitch of the fan blades lying axially opposite the drive side of the fan wheel, preferably in each case in relation to the internal combustion engine, e.g., via a bridge-like supporting structure that passes beneath it, bearing against the internal combustion engine.

With a fan assembly of the type described above, different designs can be implemented in a simple manner, while retaining the basic structure. Thus, there are fan wheels, for example, with which an air flow is provided in only one direction of flow, e.g., suctioning through the cooler toward the internal combustion engine, and by adjusting the pitch of the fan blades while maintaining the direction of flow, only the flow rate is varied, such that the cooling capacity thereof can be adjusted to the needs.

A functioning in this manner is reasonably limited, in taking into account the aerodynamic factors, to changes in the extent of the pitch, which is approx. 30°-50°.

The basic structure described herein for the fan wheel also makes it possible, however, to change the setting of the fan blades far beyond this range, thus, in particular, to also pivot the fan blades beyond a reversal position, while maintaining the movement direction for the actuator, in which the fan blades extend transverse to the rotational direction of the fan wheel, and thus in a range in which a reversal of the flow is obtained. This reversal of the flow direction means, taking into account the explanations given above regarding an arrangement of the fan wheel between the internal combustion engine and cooler, an air flow toward the cooler, thus, counter to the suction mode referred to above, a blower mode.

If it is assumed, taking into account the constructive structure discussed above, that a lower pitch of the fan blades corresponds to the starting position of the suction mode and an accordingly required lower cooling performance, then in order to increase the pitch, the actuator is moved via the spindle out of the originally given axial end position toward the spindle or supporting neck along the threaded section of the spindle, until it reaches the reversal position and, if a reversal of the flow direction is intended, beyond this point. For the reversal of the flow direction, normally only a smaller angular range is used for the angle of incidence, because, starting from the reversal position for the flow in the blowing direction, the angle of incidence is reduced toward the end position, which position corresponds to the maximum extension length of the actuator in relation to the supporting neck.

Thus, there are initially two possible operating modes, specifically a merely suctioning or blower mode, and a mode that can be changed from suctioning to blowing, or vice versa.

It is possible, within the scope of the invention, to control the pitch setting for the fan blades in both operating modes, e.g. in relation to thermal conditions, by means of the given mechanical coupling to the actuating drive, wherein the actuator is preferably supported in relation to the annular body in an axially stationary manner via the existing bearing connection.

Within the scope of the invention, it is also possible, however, to affect the pitch of the angular blades independently of the fundamentally given positive coupling to the actuating drive via certain actuation ranges, thus, in particular, with respect to the suction flow direction, through an axial play to the starting position. With a decoupling of this type, rotational rate dependent corrections of the pitch that has been set in relation to thermal conditions can be obtained for the fan blades, or it is also possible to make quick changes in the pitch in the switching range, independently of the possible actuation speed via the actuating drive, whereby, if applicable, actuating drives having a reduced output may be also be used.

With respect to the potential influences of this type, an axial clearance in the supporting of the annular body in relation to the actuator, with respect to the actuating forces acting on the fan blades, in particular aerodynamic actuating forces as well, may be provided, while retaining the basic structure, by means of which clearance, under the influence of an adjustment of the fan blades in the manner of forces increasing the pitch, an adjustment of the fan blades to a pitch that is greater than the pitch defined by the adjustment device is possible.

Thus, it is possible to increase the pitch of the fan blades defined for the starting position by the adjustment device to a greater pitch via an—in particular elastic—support, e.g. as a function of aerodynamic forces increasing over the rotational rate acting on the fan blades and/or as a function of the temperature through support by a thermal element, such that when these supporting forces are reduced, this can be set as the pitch defined by the adjustment device, thus reducing the performance demand to fan wheel. One preferred solution for this is that the fan blades, with respect to their rotational axes, are supported counter to their pivot direction, at the end position defined in the suctioning flow direction in the region of the starting position via a temperature-dependent position-changing limit stop, in particular a heat-expanding element.

Furthermore, it has proven to be beneficial when the fan blades, with respect to their pivot axes, are spring-supported counter to their pivotal direction at the end position in the suction flow direction in the region of the starting position, wherein the spring support of the fan blades, with respect to their rotational axes, is to be obtained in that the annular body in its position corresponding to the suctioning starting position for the fan blades, is subjected to spring pressure, in particular by an axial spring support of the annular body against the housing.

The basic structure for the fan assembly discussed above, having an axially adjustable actuator guided onto the supporting neck and over the spindle drive, as well as fan blades that can be adjusted in terms of their pitch via this actuator, can be varied, not only with respect to the arrangement of the drive motor for the spindle, but also with respect to the fan wheels while retaining the direction of rotation, by adjusting the reversible flow direction of the fan blades, can also be used for fan wheels in which the fan blades can be reversed in terms of their flow direction over a neutral position lying in the circumferential direction of the fan wheel. Thus, with the same basic structure, the fan assembly can implement different modes of function with only slight structural changes, which leads to significant economic advantages with respect to the rational production of fan assemblies configured to respective requirements.

The rotational drive for the spindle can occur via an electric, as well as a fluid-based, drive motor.

Further details and features of the invention can be derived from the Claims, the drawings, and also from the following description, which is substantially based on the drawings.

Figure 2:
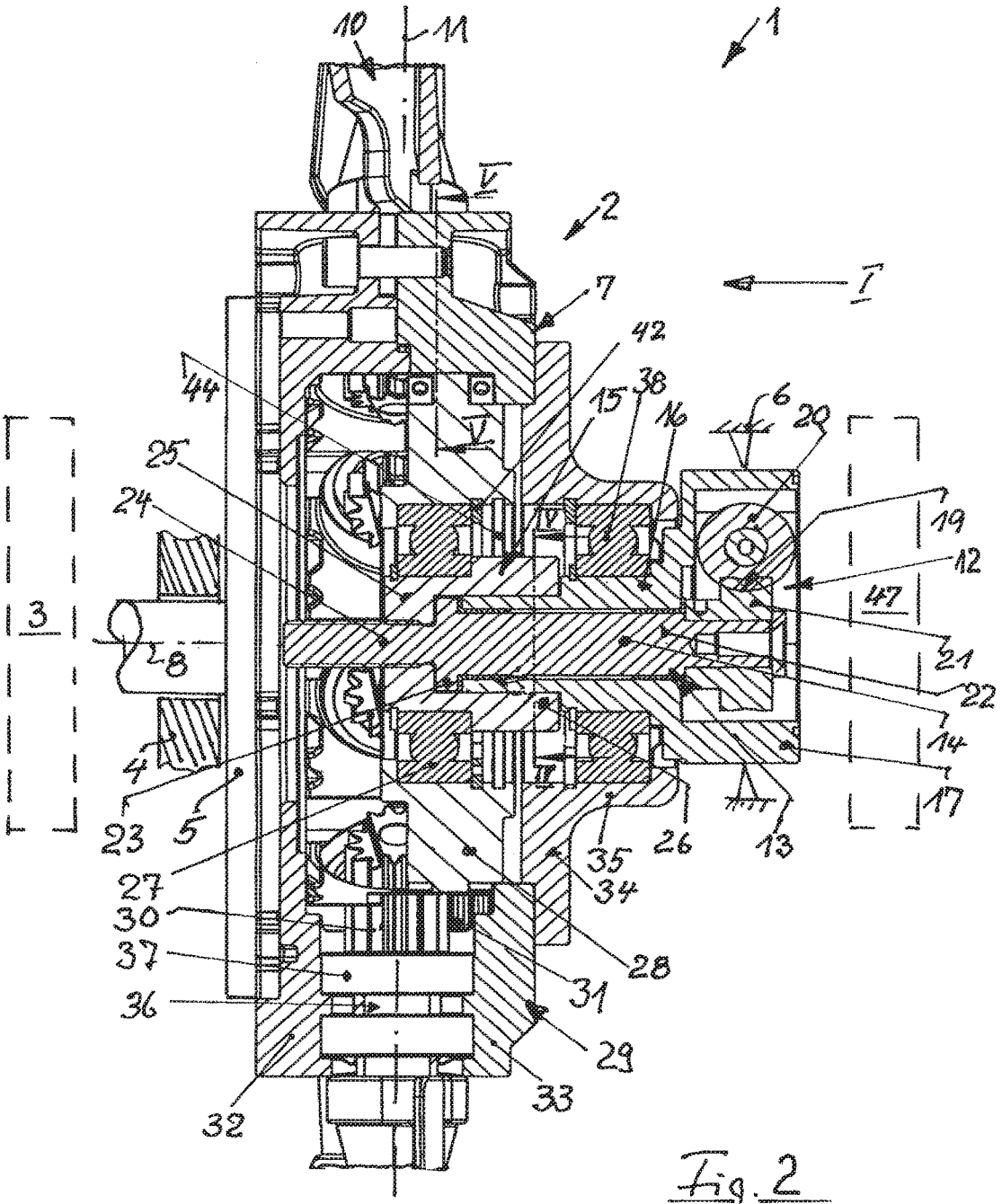
Figure 3:
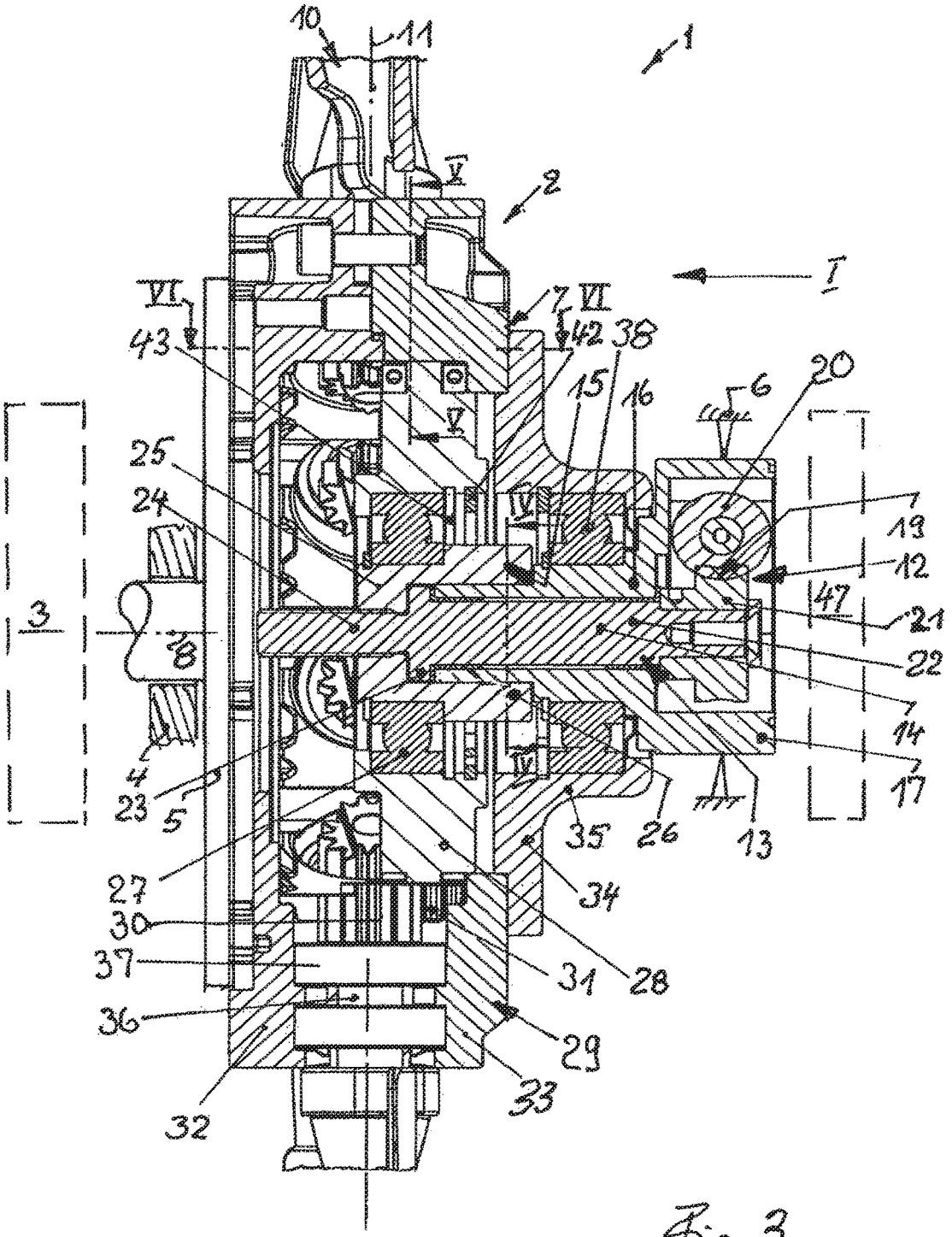
Figure 4:
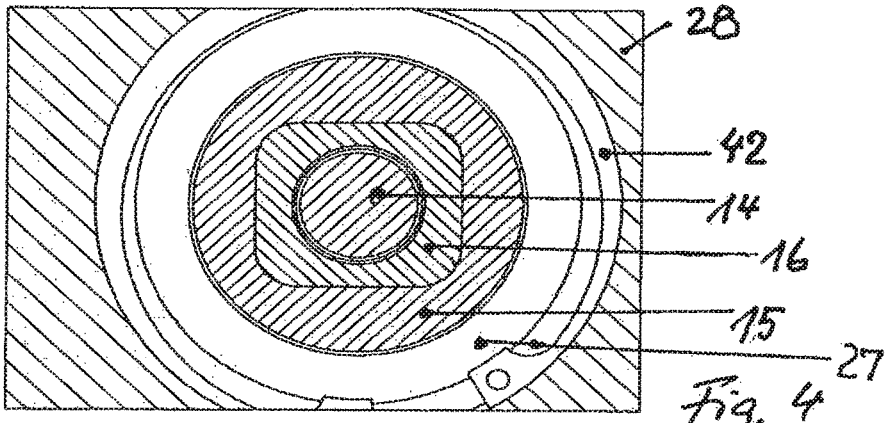
Figure 5:
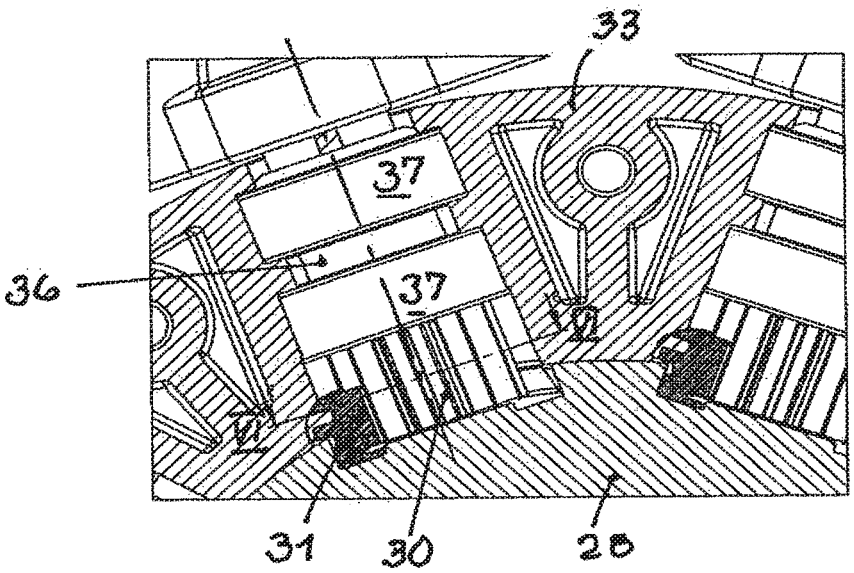
Figure 6:
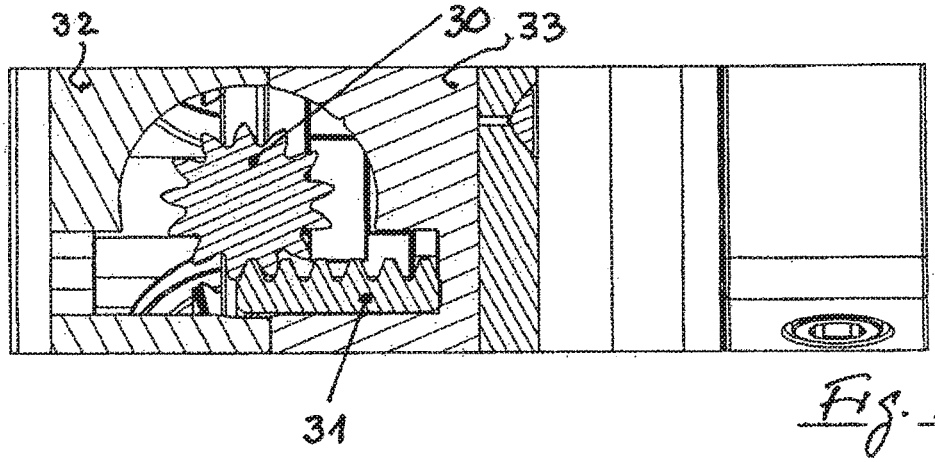
Figure 7:
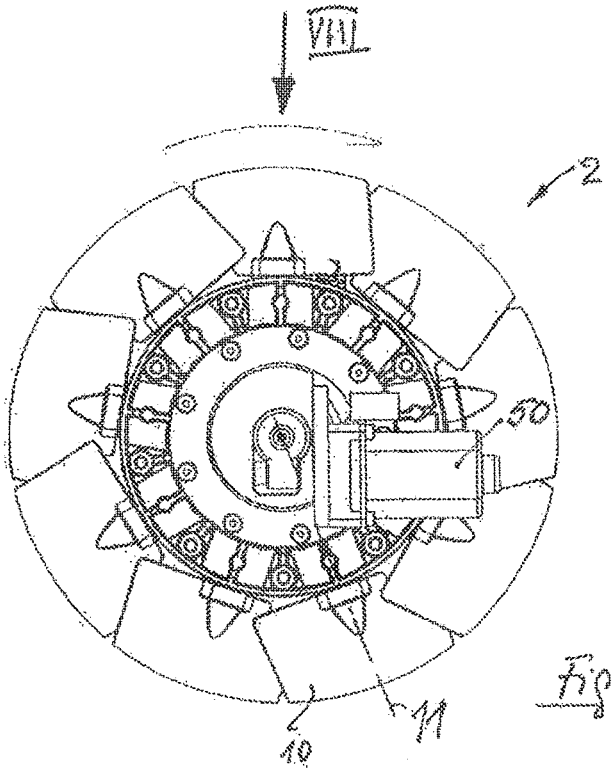
Figure 8:
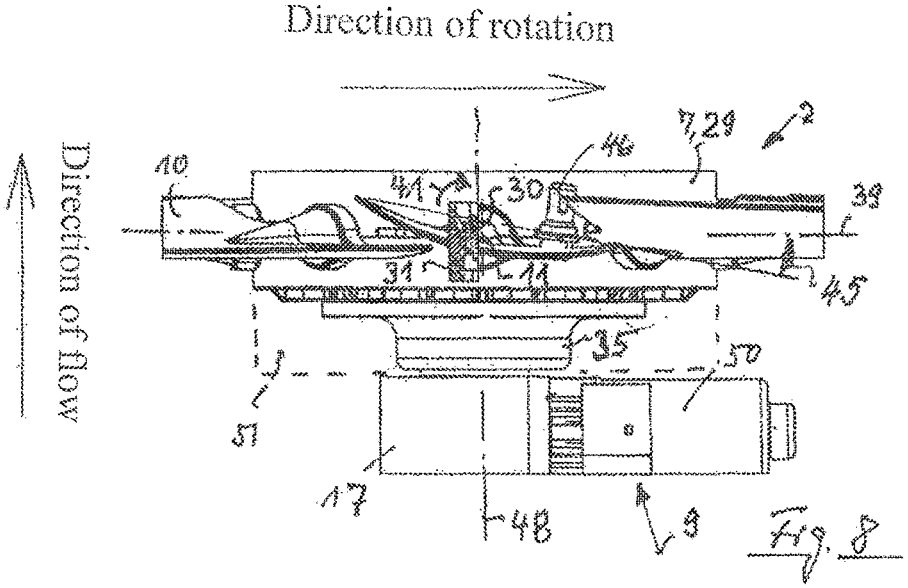
Figure 9:
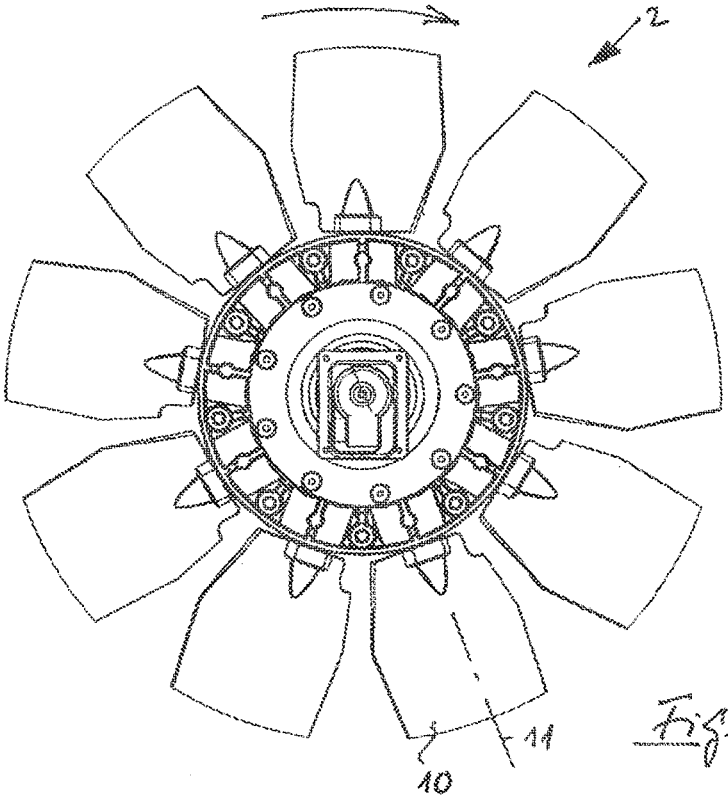
Figure 10:
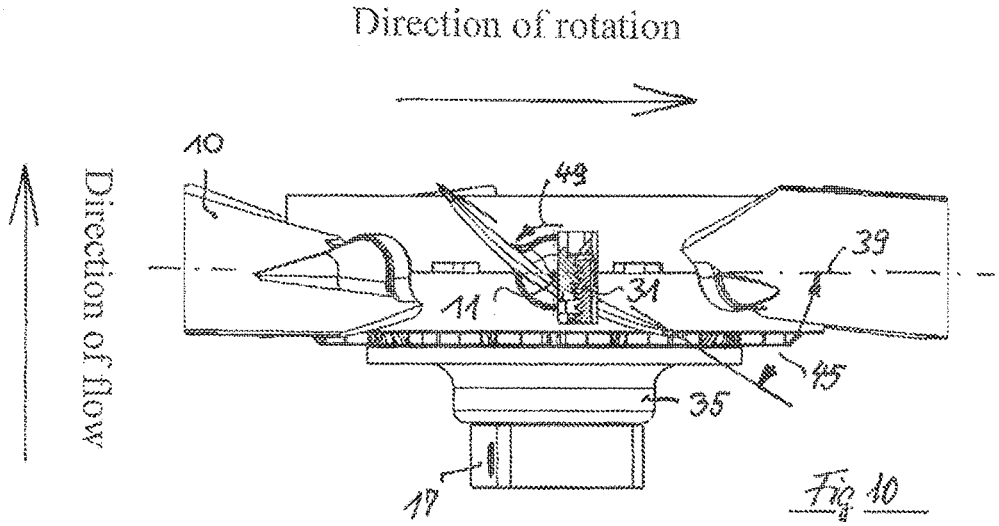
Figure 11:
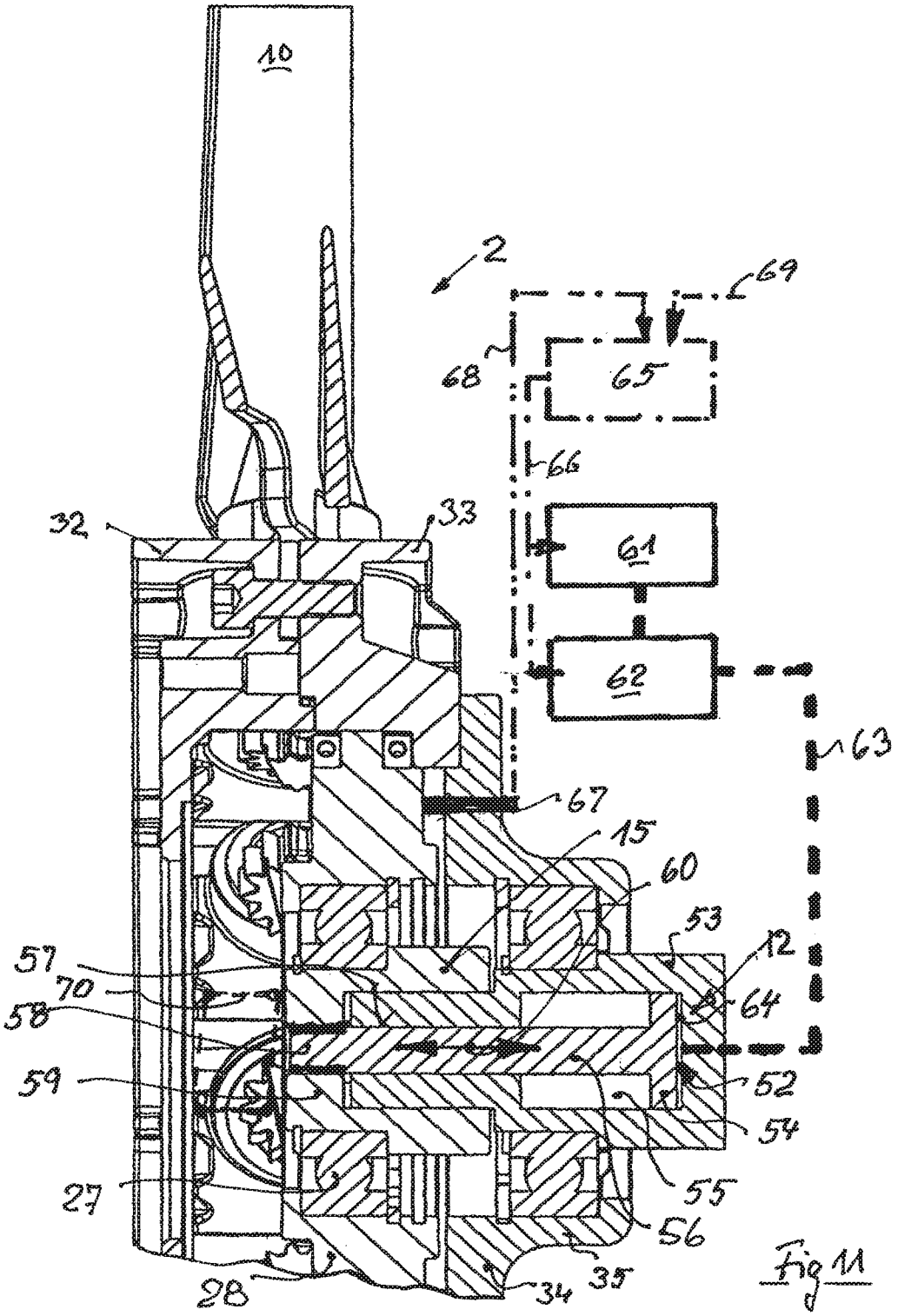

In the drawings:

FIG. 1 shows a front view of a fan wheel according to the invention, in the direction of the arrow 1 in FIGS. 2 and 3, FIGS. 2 and 3 show sections corresponding to the sectional line II-II or III-III in FIG. 1, wherein FIGS. 2 and 3 illustrate, schematically, that the adjustment of the radial blades, in relation to the hub of the fan wheel, occurs about their rotational axes in FIG. 2 in both adjustment directions without play, while in the design according to FIG. 3, play is provided for the adjustment of the fan blades in one of the adjustment directions, FIG. 4 shows a section in accordance with line IV-IV in FIG. 2 or 3, FIG. 5 shows a section in accordance with line V-V in FIG. 2 or 3, FIG. 6 shows a section in accordance with line VI-VI in FIG. 5, FIG. 7 shows a depiction corresponding to FIG. 1, of a fan wheel having a reversible flow direction, which can be reversed by rotating the fan blade about its radial rotational axis, when the fan blade is pivoted through a transverse plane to the orbital plane of the fan wheel and with an actuating motor that is attached by means of a flange to the gear housing of the fan wheel, FIG. 8 shows a radial view of the fan wheel in accordance with FIG. 7, in the direction of the arrow VIII in FIG. 7, FIG. 9 shows a depiction corresponding to FIG. 1, of a fan wheel having a flow direction that can be reversed by rotating the fan blades about their radial rotational axes, when the fan blades are pivoted through the orbital plane of the fan wheel, and FIG. 10 shows a radial view of the fan wheel in accordance with FIG. 9, in the direction of the arrow 10 in FIG. 9, and FIG. 11 shows a depiction in accordance with FIG. 2, corresponding to a partial view of a fan wheel, wherein the actuating drive for the adjustment of the fan blades is designed as a fluid-based, in particular hydraulic, linear drive, having a piston accommodated in the supporting neck functioning as a cylinder.

The fan assembly 1 illustrated in FIGS. 1 to 3 has a fan wheel 2. Regarding this fan wheel 2, the axial arrangement thereof to an internal combustion engine is schematically illustrated in FIGS. 2 and 3, as is given, for example—depicted schematically here—with an arrangement of the fan wheel 2 between the internal combustion engine 3 and a cooler 47 lying axially opposite thereof. The arrangement of the fan wheel 2 preferably occurs thereby such that it is supported against the internal combustion engine 3, by way of a flange 5 supported by a bearing 4 on the internal combustion engine 3, and an, opposite thereto, support 6 that is stationary in relation to the internal combustion engine 3. In a design of the fan assembly according to FIGS. 1 to 3, the connection of a drive source (drive motor 50) that is external to the hub 7 is provided in the region of the support 6, for a rotational drive 9 (FIG. 8), by means of which the fan blades 10 of the fane wheel 2 can be rotated about their rotational axes 11, which are disposed radially on the hub 7, and thus can be adjusted in term of their pitch 45 (FIGS. 8 and 10). This occurs via an actuating drive 12, which is actuated by the rotational drive 9, which actuating drive is designed here as a spindle drive 13, having a spindle 14 that is concentric in relation to the hub axis 8, via which an actuator 15 that is concentric to the spindle 14 can be axially displaced.

The actuator 15 functioning as a supporting body is non-rotatably supported against a preferably stationary supporting neck 16, which is disposed coaxially to the spindle 15 and, for its part, is non-rotatable in relation to the support 6, which transitions into a gear housing 17 toward the support 6. A worm gear 19 having a worm wheel 21 driven via a worm 20 is provided in the gear housing 17 in the form of a drive connection from the rotational drive 9 to the spindle drive 13, which is non-rotatable in relation to the spindle 14.

The spindle 14 has a guide section 22, which is rotatably supported on the supporting neck 16, and is supported such that it is axially stationary, and transitions into a threaded section 24 having a smaller diameter via an annular collar 23 supported axially on the supporting neck 16.

With this threaded section 24, the actuator 15 engages as a sleeve-shaped supporting body, via a threaded collar 25 that extends radially inwardly, which radially overlaps and axially adjoins a neck section 26 of the actuator 15, which, as is visible from the section according to IV-IV shown in FIG. 4, is guided on the supporting neck 16 such that it can be displaced axially, and in particular, is non-rotatable, due to a non-round connection. The supporting neck 16 has a rectangular cross section in the region of the non-round connection, and is encompassed by the neck section 26 exhibiting a corresponding inner cross section, as is visible, in particular, from FIG. 4.

In the axial region of the actuator, radially overlapping the threaded collar 25, an annular body 28 is disposed via a bearing 27 on the actuator 15, which is also axially supported via the bearing 27 in relation to the actuator 15, and thus can be axially displaced via the actuator 15, as shall be explained in greater detail below, corresponding to the direction of rotation for the spindle drive 13.

The annular body 28 and the elements lying in its connection to the spindle drive 13 lie in the radial overlapping region in relation to the fan blades 10, which in the circumference-side part of the hub housing 29 are rotatably supported about their rotational axes 11 with a radial extension, and are connected to the annular body 28, which is axially displaceable and non-rotatably supported in the hub housing 29, via drive elements. These drive elements concern a respective fan blade 10, which is rotatably supported via its pins 36, which extend radially inward, and a bearing 37 allocated thereto in the circumference-side region of the hub housing 29, formed by a pinion 30 that is stationary in relation to the rotational axis 11 of the fan blade 10, as well as a circumference-side toothed rack section 31, which in each case is non-rotatable in relation to the annular body 28, which extends in the displacement direction of the annular body 28 parallel to the rotational axis 8 of the hub 7, and engages with the respective pinion 30 with a radial lateral offset to the rotational axis 11 of the fan blade 10.

The hub housing 29, divided axially into two halves 32, 33, becomes, based on the depictions in accordance with FIGS. 1 to 3, a cover part 34, axially opposite the internal combustion engine 3 on the gear housing 17, which cover part has a neck 35 extending as far as the gear housing 17, in the region of which overlapping the supporting neck 16, the supporting neck 16 is supported axially and radially to the neck 35 of the cover part 34 via a bearing 38, by means of which a load bearing support of the fan wheel 2 between the internal combustion engine 3 and the support 6 lying axially opposite the internal combustion engine is obtained in the region of the gear housing 17.

The external appearance of a fan wheel 2 is illustrated in FIGS. 7 and 8, the fan blades 10 of which can be pivoted about radial rotational axes 11, can be pivoted to reverse the flow direction over a transverse plane that is perpendicular to the orbital plane 39 of the fan wheel 2, thus to a transverse position. The fan blades 10 are illustrated in a starting position in FIGS. 7 and 8, in which they are adjusted at a slight pitch, opening in the direction of rotation—the pitch 45 in FIG. 8—in relation to the orbital plane 39, and suctions cooling air toward the internal combustion engine 3, indicated in FIG. 2, through the cooler, not shown here, with respect to the fan wheel lying opposite the internal combustion engine 3—i.e. the suction mode of the fan wheel 2. By increasing the pitch, the air quantity conveyed in the suction direction initially increases, and upon reaching a transverse position in relation to the orbital plane 39, a dead-center is obtained. Starting from the transverse position (transverse plane 48), when the fan blades 10 are displaced further in the pivotal direction of the arrow 41 about their rotational axes 11, a flow direction opposite the suction flow direction is obtained, in which the air that is conveyed is then conveyed against the cooler, such that accumulations are blown free of the cooler—blower mode.

Starting from the reversal position (pivoting through the transverse plane 48), while retaining the rotational direction in the blower mode, an adjustment of the fan blades 10 occurs, from an initially large pitch to a smaller pitch as the end position.

If the fan blades 10 have, as can be seen in FIGS. 7 and 8, an asymmetrical construction in relation to their rotational axes 11, in which the fan blades 10 are caused to move by the aerodynamic forces in the pivot direction according to the arrow 41, then a torque is obtained over the reversal position of one of the fan blades 10, in the sense of the reversal of the flow direction from suction to blowing—in the pivot direction according to arrow 41.

A different application of aerodynamic forces from that in the direction of turning for the fan blades about their respective rotational axes can also be obtained in that the fan blades are disposed such that they are radially offset to the respective blade rotational axis with respect to their blade plane.

In accordance with the invention, this can be used as a "dead center" in the sense of a "reversal" of the fan blade 10 over its transverse position, when the actuating drive for the fan blades 10 allows for a corresponding clearance. Because a returning, quick reversal of the flow direction, from suction to blowing, is to be achieved, in order to keep the impairment of the cooling of the internal combustion engine connected to the reversal of the flow direction as short as possible during the reversal of the flow direction, such a clearance is provided in accordance with the invention.

Structurally, this is implemented with a solution according to FIG. 3 in that the annular body 28 is supported in relation to the actuator 15 in its adjustment direction corresponding to the adjustment of the fan blades 10 from suction to blowing with play in relation to the actuator 15, such that the actuator 15 can pass its axial position defined by the actuating drive, wherein the passing path is delimited, such that adjoining this play region, a coupling to the actuating drive is again obtained.

FIG. 2 illustrates a solution, in contrast thereto, in which an axially stationary connection of the actuator 15 to the annular body 28 is obtained, in order that a positive coupling between the actuating drive, the actuator 15 and the annular body 28 is implemented.

Structurally, both possibilities can be implemented in accordance with the invention while retaining the basic structure in that the bearing 27 in the case in FIG. 2 is supported in a stationary manner in relation to the annular body 28, but in FIG. 3, as described above, is supported with axial play. Both solutions can be implemented with little difficulty, in each case via a snap ring support, wherein a snap ring 42 is retained without play through interaction in a groove 43 on the annular body 28 provided on the back surface of the bearing 27. A corresponding engagement groove 44 is provided with the solution according to FIG. 3, having an axial spacing to the bearing 27, with which the axial clearance that is intended is delimited. The corresponding grooves 43, 44 can both be provided in an annular body 28 without compromising the respective solution, such that the same components can be used for both solutions.

Thus, it is also possible, in accordance with the invention, to operate fan blades 10 according to FIGS. 7 and 8 or fan blades 10 according to FIGS. 9 and 10, with the same, or at least substantially the same construction regarding the actuating drive and its drive connection to the fan blades 10 via the annular body 28, which fan blades differ from one another with respect to the reversal of the flow direction through adjusting the fan blades 10, in that the fan blades 10 in the solution according to FIGS. 7 and 8 are adjusted over the transverse position, and in the solution according to FIGS. 9 and 10 are adjusted over a neutral position, in which the planes of the fan blades 10 extend into the orbital plane 29 of the fan wheel 2. A solution of this type requires a positive guidance of the fan blades 10 with respect to their pivotal positions about their respective rotational axes 11, as is illustrated with an axially stationary support of the actuator 15 in relation to the annular body 18 in the solution according to FIG. 2.

In FIGS. 2 and 3, the drive elements interacting with the annular body 28 for converting the axial movements thereof into corresponding rotational movements of the fan blades 10 are referred to as the toothed rack sections 31 and the pinions 30. The pinions 30 are non-rotatable in relation to pins 36 of the fan blades 10, the toothed rack sections 31 extend tangentially to the pinions 30 in the displacement direction of the annular body 28, and are disposed in a stationary manner on the circumference of the annular body 28. FIGS. 8 and 10 illustrate that, depending on the required pivot direction (arrow 41 or 49) of the fan blades 10 with respect to the feed direction of the annular body 28, the toothed rack sections 31 are laterally offset in relation to the pinion 20, thus, in relation to the pinion 30, are to be disposed on opposite sides thereof. As a result, it is possible, for the fan blade variations according to FIGS. 7 and 9, to design the drive connection of the annular body 28 to the fan blades 10 with the same components, wherein the annular body 28 is structurally designed for this, with respect to the offset arrangement and attachment of the toothed rack section 31, by means of corresponding insert receivers for a respective toothed rack section 31, for example.

With a solution according to FIGS. 7 and 8, the given axially delimited clearance between the actuator 15 and the annular body 28 can also be used to increase the pitch 45 provided in the starting position for the fan blades 10 that are overlapping in relation to the actuating drive, via an actuator 46 that functions in a temperature dependent manner, as required, if, for example, the internal combustion engine 3 that is to be cooled is operated at a high load with a low rotational rate, and accordingly, a fan wheel 10 that is operated at a lower rotational rate would remain inadequate in terms of its cooling power with respect to the requirements for the internal combustion engine 3. As a temperature dependent functioning actuator 46, a thermal-wax element may be provided, as indicated in FIG. 8, for example, which, lying and supported at the circumferential side of the hub housing 29, acts on a respective fan blade 10 from the back in in order to increase the pitch 45.

A drive solution for the actuating drive 12 is illustrated in FIGS. 7 and 8 with respect to solutions according to the invention, in which a drive motor 50 in the form of an electric motor—a hydraulic motor is also a possibility—is provided. This is depicted as being connected thereto by a flange in a direct allocation to the stationary gear housing 17, fixed in place by the support 6, this being in a radial extension toward the rotational axis 8 of the hub 7, such that the fan assembly 1 has a flat construction. FIG. 8 also illustrates that an annular space remains in the form of an empty space 51 around the neck 35 of the cover part 34 of the hub housing 29 with a solution of this type, which annular space is suitable for placing a drive motor 50 therein, such that further drive concepts with an overall flatter construction of the fan assembly going beyond the illustrated solution are also possible. The empty space 51 is indicated by a broken line.

The depiction according to FIG. 11 corresponds substantially to that according to FIG. 2, such that with regard to the previous description, reference is made in particular to the explanations regarding FIG. 2, wherein, in accordance with this reference, the same reference symbols are used for identical parts.

In differing from the depiction in accordance with FIG. 2, although the actuating drive 12 is again a linear drive, it is now designed in the manner of a piston drive 52, and accordingly, the supporting neck 53 is provided with a cylinder chamber 55 for receiving the piston 54 of the piston drive 52. The piston 54 transitions into a piston rod 56, which passes through the cylinder chamber 55 and, starting from the cylinder chamber 55, runs, through a guide hole 57 of the supporting neck 53, into an end section 58, which axially overlaps a collar 59 of the actuator 15, and is connected thereto, at least axially, but preferably, axially and radially, in a stationary manner, by mean of a threaded connection, for example, which is not shown here.

By subjecting the piston 54 to an appropriate pressure, the piston can be displaced axially, as indicated by the arrow 60, and carries the actuator 15 with it thereby, accordingly, such that, aside from the different design for the actuating drive 12, on one hand as a piston, and on the other hand as a spindle drive, the same functional sequences with regard to the adjustment of the fan blades 10 are provided.

In order to adjust the fan blades 10 through axial displacement of the piston drive 52, a hydraulic actuation is schematically illustrated in FIG. 11, this being starting from a pressure source 61 in the form of a pump or reservoir, at the location of which a connection to already existing pressure sources can also be created. A valve assembly 62 is subjected to pressure via the pressure source 61, at which point the supply of the working fluid to the cylinder chamber portion 64 delimited by the piston 54 occurs via the supply line 63. The valve assembly 62 preferably functions in a clocked manner with respect to a pressurization of the cylinder chamber portion 64 that is adjusted as finely as possible in the known manner, wherein the activation of the valve assembly 62, and if applicable, the activation of the pressure source 62 as well, occurs via a control line 66 from the control device 65, which addresses the valve assembly 62 as a function of the respective given blade pitch of the fan blades 10 and taking into account the respective given cooling power requirement, as well as other parameters, if applicable.

In order to determine the respective blade angle of the fan blades 10, a sensor assembly 67, e.g. in the form of a Hall sensor, is indicated in FIG. 11, which sensor is connected to the control device 65 via a control line 68, wherein a corresponding processing of the specified parameters occurs in the control device 65, if applicable in conjunction with further parameters, which are provided via a control line 69, from a motor control device for example. As a matter of course, instead of the control device 65, a direct control of the valve assembly 62 can also be achieved via a motor control device that is not depicted here.

The clocked activation of the valve assembly 62, taking into account corresponding working parameters, such as the blade angle, for example, is known, for example, from the German Patent application 10 2011 101 494 submitted by the applicant, as well as from other documents. It is also within the scope of the invention that the hydraulic activation, as a function of the respective parameters that are to be taken into account, can be implemented via a proportionally functioning valve assembly 62, in particular a proportional valve.

In FIG. 11, a pressurization of the piston 54 is depicted, in which the piston is subjected to pressure from only one side, shown in conjunction with a schematically indicated spring support in the opposite direction by means of a spring 70. Pressurization from both sides, and thus the adjustment of the piston 54 in the opposite direction, as indicated by the arrow 60, can be implemented in a corresponding manner.

Analogous to the assembly of the spring support via a spring 70 shown in FIG. 11, but instead of such a spring, a spring support, not shown, can be provided here, lying axially opposite, between the actuator 15 and the cover part 34, in particular the supporting neck 53 that is stationary in relation to the cover part 34, by means of which the fan blades 10—through a pressure applied to the annular body 28—are supported in a spring-loaded manner against their pivot direction on the end position defined in the suction flow direction in the region of the starting position.

The invention claimed is:

1. A fan assembly having a rotatingly driven hub comprising a hub housing, with a plurality of radial fan blades that can be pivoted toward the hub housing, with a central stationary supporting neck, on which the hub housing is supported in an axially stationary and rotationally supported manner, and with an actuating drive for the fan blades, which has a linear drive with an actuating element inserted into the supporting neck and an actuator that can be axially displaced via the actuating element, wherein an annular body that is non-rotational relative to the hub housing is radially supported in relation to the actuator and connected to the fan blades that can be adjusted in terms of their pitch via a plurality of drive elements that are engaged eccentrically in relation to the rotational axes thereof, wherein the actuator comprises a support body on the supporting neck that is axially displaceable and is guided thereon in a non-rotating manner wherein the actuating element of the linear drive comprises a spindle guided and supported in the supporting neck in an axially stationary manner, and the axially displaceable actuator comprises the support body encompassing the free end of the supporting neck, in the shape of a sleeve formed over the spindle.

2. The fan assembly according to claim 1, wherein the spindle, supported in an axially stationary manner, has a guide section that is axially and radially supported in relation to the supporting neck and a threaded section that is offset thereto, in particular radially and axially.

3. The fan assembly according to claim 2, wherein the supporting neck is expanded to form a gear housing at the end lying opposite the threaded section.

4. The fan assembly according to claim 2, wherein, with respect to the hub axis, the drive for the spindle is provided axially opposite the drive for the hub.

5. The fan assembly according to claim 2, wherein the fan wheel is supported, in a stationary manner, in the region of the axially opposing drive-side connections to the spindle and the hub.

6. The fan assembly according to claim 1, wherein the supporting neck is expanded to form a gear housing at the end lying opposite the threaded section.

7. The fan assembly according to claim 1, wherein, with respect to the hub axis, the drive for the spindle is provided axially opposite the drive for the hub.

8. The fan assembly according to claim 1, wherein the plurality of radial fan blades comprises a fan wheel supported, in a stationary manner, in the region of the axially opposing drive-side connections to the spindle and the hub.

9. The fan assembly according to claim 1, wherein the actuator is non-rotatably supported and axially guided onto the supporting neck via a non-round cross section.

10. The fan assembly according to claim 1, wherein the fan blades, which can be adjusted in terms of their pitch, in order to reverse the flow direction from suction to blowing—and vice versa—via a neutral position lying in the circumferential direction of the fan blade, starting from a large pitch of the fan wheel in the suctioning flow direction as the starting position, via the neutral position, to a large pitch in the blowing flow direction as the end position.

11. The fan assembly according to claim 1, wherein the annular body is supported in relation to the actuator (15) in an axially stationary manner.

12. The fan assembly according to claim 1, wherein the annular body is supported in relation to the actuator in an actuating direction such that it is axially stationary, and in the opposite direction, is limited in terms of its motion, with an axial clearance.

13. The fan assembly according to claim 12, wherein the plurality of radial fan blades can be adjusted from a starting position, and a small pitch to a larger pitch, and in that the annular body is supported in relation to the actuator-in a manner in which the path is delimited with an axial clearance counter to the direction of actuation, which corresponds to the adjustment of the pitch of the fan blades to a greater pitch.

14. The fan assembly according to claim 12, wherein, the annular body can be axially displaced between a starting position and an end position, and an increasing pitch of the fan blade from the starting position to the end position of the annular body, the annular body is supported in relation to the actuator in the actuation direction at the end position in an axially stationary manner, and is supported with an axial play in the actuation direction from the end position to the starting position.

15. The fan assembly according to claim 12, wherein the fan blades that can be adjusted in terms of their pitch to reverse the flow direction from suction to blowing over a reversal plane lying transverse to the orbital plane of the fan wheel, starting from a small pitch of the fan blades in the suction flow direction, as the starting position—over the reversal plane with fan blades lying transverse to the orbital plane of the fan wheel—to a small pitch in the blowing flow direction as the end position—and vice versa—and in that the fan blades are forced toward their end position defined in the blowing flow direction with respect to their pitch in the direction of the rotational adjustment, and in the direction of the opposite rotational adjustment, toward their starting position defined for the suction flow direction, have large given rotational angle play.

16. The fan assembly according to claim 1, wherein the fan blades, respectively in relation to rotational axes with respect to the hub, in particular with an asymmetric design, are aerodynamically unevenly subjected to forces and are subjected to aerodynamic forces functioning against the rotational direction, toward a reduction of their opening pitch in the rotational direction of the fan blade.

17. The fan assembly having a rotatingly driven hub comprising a hub housing, with a plurality of radial fan blades that can be pivoted toward the hub housing, with a central stationary supporting neck, on which the hub housing is supported in an axially stationary and rotationally supported manner, and with an actuating drive for the fan blades, which has a linear drive with an actuating element inserted into the supporting neck and an actuator that can be axially displaced via the actuating element, wherein an annular body that is non-rotational relative to the hub housing is radially supported in relation to the actuator and, wherein the linear drive comprises a piston drive and the actuating element comprises a piston, that is received such that it can be axially displaced in a cylinder chamber of the supporting neck, and an actuator, that is at least supported in an axially stationary manner, a piston rod-received in the supporting neck, the actuator comprising the supporting body encompassing the supporting neck at the free end thereof, in particular in the shape of a sleeve.

18. The fan assembly according to claim 17, wherein the actuator is non-rotatably supported and axially guided onto the supporting neck via a non-round cross section.

19. The fan assembly according to claim 17, wherein the fan blades, which can be adjusted in terms of their pitch, in order to reverse the flow direction from suction to blowing—and vice versa—via a neutral position lying in the circumferential direction of the fan blade, starting from a large pitch of the fan wheel in the suctioning flow direction as the starting position, via the neutral position, to a large pitch in the blowing flow direction as the end position.

* * * * *